United States Patent [19]

Grace et al.

[11] Patent Number: 4,691,827

[45] Date of Patent: Sep. 8, 1987

[54] SUPPORTED PACKAGE ATTACHED TO PANEL IN PARALLEL SLOTS

[76] Inventors: Ronald Grace; Mary D. Grace, both of 61 Inverlochy Boulevard, Unit 11, Thornhill, Ontario, Canada, L3T 3R4

[21] Appl. No.: 861,337

[22] Filed: May 8, 1986

[51] Int. Cl.[4] ..... B65D 73/00; A45C 11/28

[52] U.S. Cl. ..... 206/465; 206/0.83; 206/45.33; 206/466; 206/472; 206/495

[58] Field of Search ..... 206/461, 462, 463, 464, 206/465, 466, 45.33, 530, 531, 0.8, 0.82, 0.83, 0.84, 478, 495, 472, 479, 473, 490, 487, 482

[56] References Cited

U.S. PATENT DOCUMENTS

| | | | |
|---|---|---|---|
| 1,209,461 | 12/1916 | MacCanlis | 206/487 |
| 2,030,996 | 2/1936 | Lustig | 206/482 X |
| 2,254,893 | 9/1941 | Hires | 206/495 |
| 2,571,073 | 10/1951 | Stroop | 206/0.8 |
| 2,802,569 | 8/1957 | Massey | 206/462 |
| 2,941,664 | 6/1960 | Palmer | 206/464 |
| 2,993,590 | 7/1961 | Denton | 206/464 X |
| 3,035,693 | 5/1962 | Ehrler | 206/465 X |
| 3,061,091 | 10/1962 | Wichman | 206/462 |
| 3,193,090 | 7/1965 | Hudgeon, Sr. et al. | 206/0.83 |
| 3,314,535 | 4/1967 | Jarecki | 206/462 X |
| 3,533,501 | 10/1970 | Dorsett | 206/0.82 |
| 3,809,217 | 5/1974 | Harrison | 206/0.84 |
| 3,913,732 | 10/1975 | Peterson | 206/0.83 |
| 4,385,688 | 5/1983 | Grant | 206/0.83 |
| 4,429,787 | 2/1984 | Morse | 206/0.83 |

FOREIGN PATENT DOCUMENTS

| | | | |
|---|---|---|---|
| 662471 | 5/1963 | Canada | 206/465 |

*Primary Examiner*—George E. Lowrance
*Assistant Examiner*—Bryon Gehman
*Attorney, Agent, or Firm*—Ridout & Maybee

[57] ABSTRACT

A supported package for displaying small items such as coins is formed from a tubular sleeve, for example of MYLAR (trade mark) film or the like and which is flattened and removably attached on a planar support surface which comprises a series of transversely spaced transversely elongated members, which may, for exmaple, be formed by slits in the support surface, each having associated with it an opening formed by a longitudinally extending pair of opposed edges through which at least a portion of the flattened sleeve is passed. The package can be readily formed or adjusted to accommodate snugly items such as coins of differing sizes, and the packages can be readily mounted, moved and rearranged on the display surface.

8 Claims, 22 Drawing Figures

SUPPORTED PACKAGE ATTACHED TO PANEL IN PARALLEL SLOTS

The present invention relates to a supported package for displaying coins or other collectables, medals, medallions, samples and like small items.

Currently available coin display systems include wallet and binder sheets provided with transparent pockets, window-style packets, envelopes, rigid containers, bags and presized holes in display boards. Unlike the package of the present invention, all of the aforementioned systems known to the inventor are presized and allow little flexibility in the arranging of coins of various sizes.

The present invention provides a supported package for displaying small items, comprising a generally tubular sleeve comprising transparent material through which a small item placed inside the sleeve can be viewed, and a generally planar support surface on which said sleeve in flattened form is removably attached, said surface comprising a series of transversely spaced elongated members each having associated with it at least one opening defined between a longitudinally extending pair of opposed edges through which at least a portion of said flattened sleeve is passed.

The sleeve may be formed of folded sheet material, and in one preferred form the sleeve is wrapped around the member and the ends of the sleeve joined to form a package into which a product is placed. In another preferred form, the ends of a sleeve containing an item are tucked under a member and the ends may then be held in place by a backing surface or surfaces. This produces a closed package. With the preferred forms of the invention, all package to display attachment devices are unnecessary and because conventional package sealing methods such as heat and glue are not required, a wide range of flexible packaging materials may be used without special treatments or coatings being employed. This is of particular advantage when the small item is sensitive to the package or the package must provide protection to the small item. The package is easily mounted, moved and rearranged on the support surface, making the best use of the available space. In the preferred forms, the sleeve can be formed or adjusted to snugly receive coins or collectables of various sizes, which can be displayed side by side, allowing the displayer a greater range of display sequence options.

The present invention will now be more fully described, by way of example only, with reference to the accompanying drawings, wherein.

Figure 1:
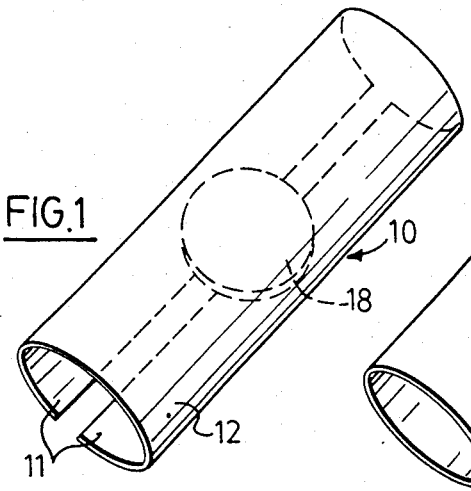
FIGS. 1, 2 and 3 show perspective views of a sleeve formed by folding sheet material, a sleeve formed by tube material, and a sleeve in the form of a bag, respectively.
Figure 2:
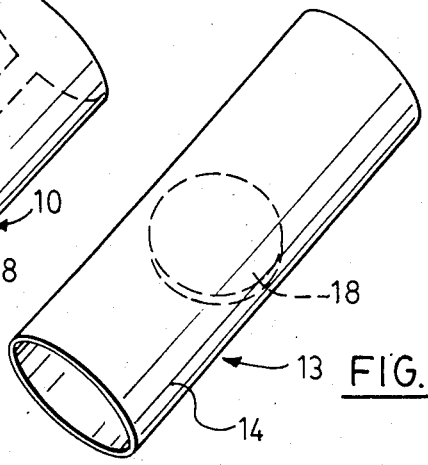
Figure 3:
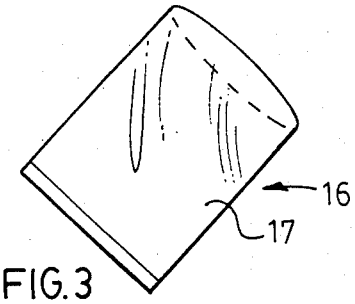

FIGS. 1, 2 and 3 show various forms of tubular sleeve, forming a first component of a supported package, in which a small item may be displayed. As seen in FIG. 1, a sleeve 10 may be formed by folding over the edges 11 of sheet material 12. The edges 11 may be overlapped, and may be bonded together, e.g. by heat sealing or by the use of adhesives or the like.

FIG. 2 shows a sleeve 13 of tubular material 14.

FIG. 3 shows a sleeve 16 in the form of an elongate bag formed, in this instance, by sealing one end of a tube 17. Other forms of bag may be employed having, for example, seals along an edge or edges or along a median portion.

In each case, the sleeve 10, 13 or 16 comprises at least a portion which is transparent, so that a coin 18 or the like placed inside can be viewed. Normally, the whole of the sleeve will be of transparent material, but it would be possible to employ sleeves with, for example, opaque end portions.

Figure 4:
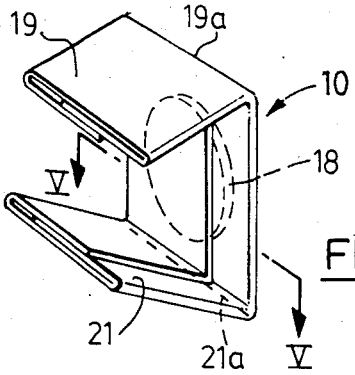
FIG. 4 shows a step in the folding of a sleeve in accordance with FIG. 1, during course of formation of a supported package in accordance with the invention.
Figure 5:
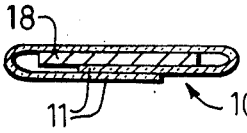
FIG. 5 shows a cross-section taken on the line 5—5 in FIG. 4.

FIGS. 4 and 5 show a package wherein a sleeve formed from folded sheet material, e.g. sleeve 10 as shown in FIG. 1, has its ends 19 and 21 bent to the rear side in order to facilitate attachment of the sleeve containing the coin 18 or the like to a support surface. As seen in FIGS. 4 and 5, normally the sleeve is flattened to form a generally rectangular flat package conforming fairly tightly to the sides and edges of the coin 18 or other item. Although it is preferred to overlap the sleeve edges 11, it is not necessary and the coin or other item can be secured in the sleeve with a minimal amount of sleeve material around the edges of the coin or other item.

A second component of the supported package of the present invention comprises a support surface comprising a series of transversely spaced elongated members each having associated with it at least one opening defined between a pair of opposed edges through which a portion of the flattened sleeve is passed.

Figure 22:
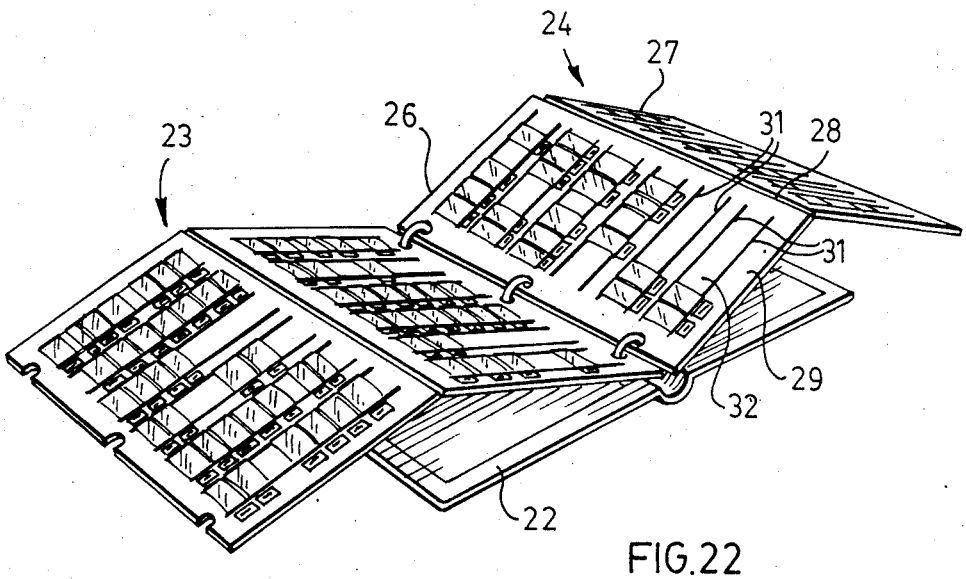
FIG. 22 shows a perspective view of a bound form of a supported package arrangement in accordance with the invention.

In one preferred form of the present invention, the support surface comprises a planar sheet, preferably of card or the like, which is slit along a series of parallel lines. Each slit or opening forms a pair of the above-mentioned edges, and adjacent pairs of these slits define the above-mentioned members. For example, referring to FIG. 22, this shows a bound form of the supported package arrangement of the present invention wherein a three ring binder 22 carries two leaves 23 and 24. Each leaf comprises two rectangular sections 26 and 27 hinged or otherwise articulated together along a hinge line 28. Each section consists of a card or other member forming a support surface 29 through which are cut adjacent pairs of elongated slits 31. These slits 31 are spaced apart transversely. Each adjacent pair of slits 31 defines between it an elongated member 32. Flattened sleeves 10 containing coins or similar items are attached to the members 32. Between the members 32, the support surface 29 provides spaces in which notes or other indicia concerning the displayed items can be written, or on which labels pertaining to the adjacent displayed items can be affixed.

Figure 6:
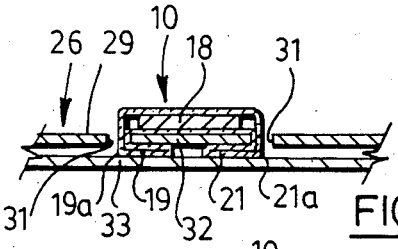
FIGS. 6 to 11 show, somewhat schematically, side views, partly in section, through various forms of supported package in accordance with the invention.
Figure 21:
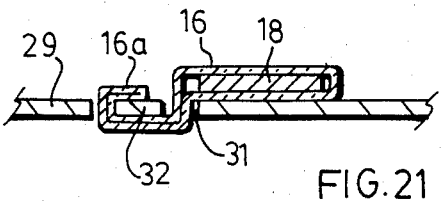

FIG. 6 shows a side view, partially in section through a sleeve 10, such as shown in FIG. 4, illustrating one arrangement for attachment to a support surface, such as the support surface 29 shown in FIG. 21. As seen in FIG. 6, associated with the support surface 29 is a planar backing surface 33 which may be of card or the like, the card having the slits 31 and forming the support surface and members 32 being attached at its edges to the card forming the backing surface 33.

As will be appreciated, for the sake of clarity of illustration, the width of the openings of the slits 31, and the spacing between the support surface 29 and the backing surface 33 are greatly exaggerated. These and corresponding distances and dimensions are likewise similarly exaggerated in the remaining Figures of the accompanying drawings. Normally, for example, there is little or no appreciable spacing between the pairs of opposed edges defining the slits 31 and each edge of the member 32 is substantially contiguous with the adjacent edge of the surface 29. Likewise, the upper face of the backing surface 33 and the lower face of the support surface 29 are normally touching or closely adjacent and there is little or no spacing between them such as shown in FIG. 6.

In use, the package 10, as shown for example in FIG. 4, may be applied to the support surface by inserting the ends 19 and 21 of the package through the slits 31 so that the ends 19 and 21 are held by being compressed between the backing surface 33 and the lower side of the support surface 29. A thin, preferably blunt ended implement, for example a round ended thin blade or the like may be used in order to poke the free ends 19 and 21 of the package through the slits 31 to their position underlying the member 32.

As will be appreciated, the sleeve 10 can be readily removed by pulling it forcibly upwardly to free the ends 19 and 21, thus permitting the array of displayed items on the surface 29 to be rearranged or replaced. In the preferred form, the material of which the tubular sleeve is made is a material having a dead fold characteristic so that, when the free ends 19 and 21 are folded over as shown in FIG. 4, and creased tightly along lines 19*a* and 21*a*, they tend to take a permanent set or crease, particularly if the folds are creased strongly, so that, once the folded ends 19 and 21 are inserted to the interior position shown in FIG. 6, they resist unfolding about the crease lines 19*a* and 21*a*, respectively and therefore resist withdrawal through the slit 31 and resist removal or dislodgement of the sleeve 10 from the support surface 29. The folds 19*a*, 19*b* and 21*a*, 21*b* will locate the ends of the sleeves 19 and 21 butted against the outer edge of the slits or slots 31 during sleeve withdrawal, further restraining dislodgement. In the preferred form, the sleeves such as the sleeves 10, 13 and 16 shown in FIGS. 1 to 3 are formed of a tough transparent polyester film material, which has good characteristics of inertness with respect to metals and the like, and which has an excellent dead fold or creasable property. The preferred form of polyester film is that sold under the trade mark MYLAR.

Although in FIG. 6 the members 32 and the pairs of opposed edges or slits 31 are provided by slitting a piece of card or the like, it will be appreciated that the members and pairs of opposed edges can be formed or provided in various other manners. For example the members 32 could be formed by rods, bars, or panels or portions of panels or the like, which are disposed in front of, as part of, or behind the display surface. For example, the ends of the packages 19 and 21 could be trapped by wires placed on or behind a support surface formed by a card or the like. In such case, the wire forms one opposed edge and the adjacent portion of the card or the like on which the wire lies forms the other opposed edge. Equally, the display surface can be formed by a series of members, for example parallel wires, connected to a rectangular frame or the like, with adjacent pairs of wires defining pairs of opposed edges which can engage portions of the sleeve passed therebetween. The members may be, for example, integral with the support surface, and may be formed by, for example, up-folded strip-like portions of a card or like sheet material, connected to the remaining portions of the card by Z-shaped folds or the like, the edges of these strip-like portions thus overlapping the adjacent portions of the card and providing recesses within which portions of the sleeve can be trapped or retained.

Figure 7:
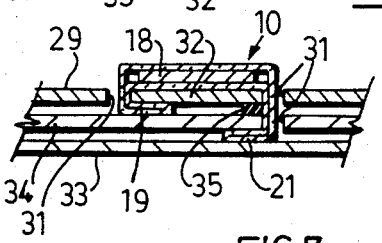
Figure 8:
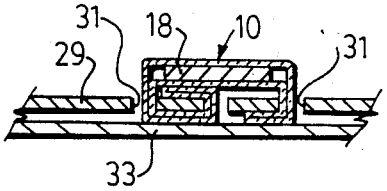

FIG. 7 shows an example wherein the support surface 29 is formed with adjacent pairs of slits 31, and interposed between the backing surface 33 and the surface 29 is an auxiliary sheet 34 formed with a slit 31, and joined to the members 32 formed in the facing sheet 29 along bonding or glue lines shown, for the sake of clarity of illustration, with greatly exaggerated thickness at 35 in FIG. 7. In this instance, one end 19 of the package is received in compression between the auxiliary sheet 34 and the facing sheet 29 and the other end 21 is received in compression between the auxiliary sheet 34 and the backing sheet 33.

Other arrangements are, of course, possible For example, instead of having the ends 19 and 21 passed through respective slits 31, both ends 19 and 21 may be passed through the same slit 31. For example, one end portion 19 of the sleeve may be folded under the intermediate portion of the sleeve 10 containing the coin 18, and may be passed through the same slit or series of slits 31 as the end 21.

Figure 9:
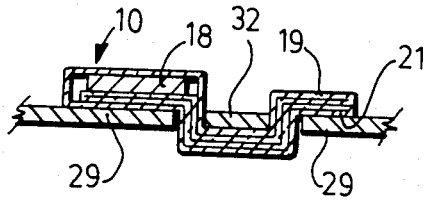

FIG. 9 shows an alternative arrangement wherein both end portions 19 and 21 are passed through the opening or slit 31 defining a pair of opposed edges, underneath a member 32, and upwardly and onto the outer face of the support surface 29 through a second pair of opposed edges or slit 31.

Figure 10:
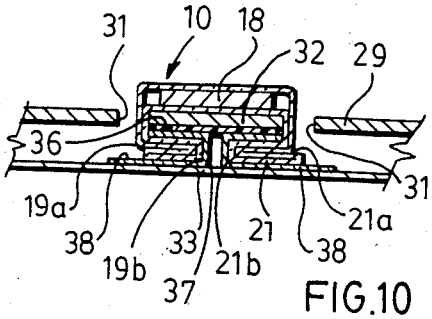

FIG. 10 shows a highly advantageous preferred arrangement wherein a member 32 defined by two adjacent slits 31 has adhered to its underside, e.g. by a layer of glue 36 or the like a pair of auxiliary strips 37 of sheet material, e.g. of paper. An end 38 of each strip 37 is folded over adjacent the backing surface 33, in order to form a longitudinally extending recess adjacent the underside of the member 32. The ends 19 and 21 of the sleeve 10 are folded over on themselves, and the folded over end is inserted into the recess formed by the strip 37, as seen in FIG. 10. Desirably, as shown, the free end 38 of the paper strip adjacent the backing surface 33 is at least as long as, or preferably substantially longer than the folded over portion of the end 19 or 21. This provides a highly secure attachment of the sleeve 10, particularly where the sleeve is of a relatively stiff film material, e.g. MYLAR film having a good dead fold characteristic since the strip 37 confines the folded over end 19 or 21 against transverse movement, and, in order to withdraw the ends 19 or 21 through the narrow slit 31, the folded over end portions 19 must be unfolded against the tendency for the strip 37 to confine its movement transversely in the direction parallel to the general plane of the display surface sheet 29. The folds 19*a*, 19*b* and 21*a*, 21*b* will locate the ends of the sleeves 19 and 21 butted against the outer edge of the slits or slots 31 during sleeve withdrawal, further restraining transverse movement. The spacing between the opposed edges of each slit 31 is zero or much less than the length of the end portions folded over on themselves (between creases 19*a* and 19*b*, for example) and therefore the portion folded over on itself cannot be withdrawn directly through the slits or other gaps 31.

Figure 11:
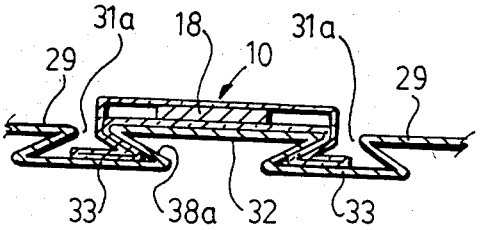

FIG. 11 shows a further embodiment wherein a result similar to that of FIG. 10 is achieved employing auxiliary portions 38*a* which are formed integrally with the members 32 and with the backing surface 33 and support surface 29, and wherein these elements, together with spaces 31*a* corresponding to the slits 31, are formed by Z-folding a continuous sheet of material e.g. card or the like.

Figure 12:
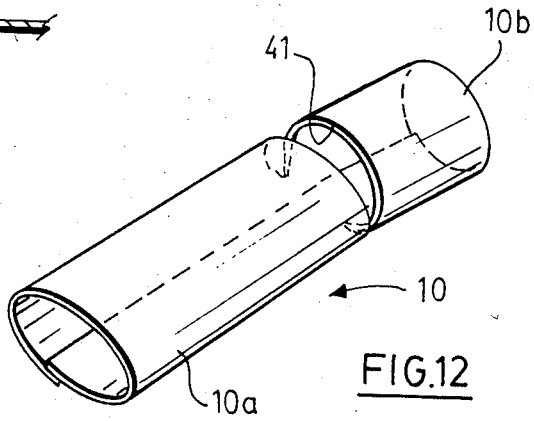
FIG. 12 shows a perspective view of a sleeve cut to form joined first and second sleeve portions.
Figure 13:
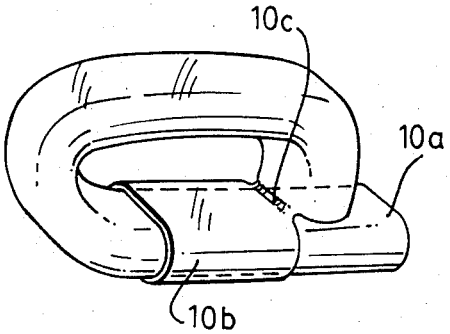
FIG. 13 shows, somewhat schematically, a step in the course of forming the sleeve of FIG. 12 into a package.
Figure 14:
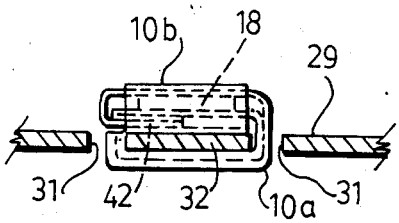
FIGS. 14 and 15 show, somewhat schematically, side views, partially in section, through supported packages in accordance with the invention.

In FIG. 12, a sleeve, such as the sleeve 10 is cut transversely at 41 to define a first or major portion 10*a* and a second or minor portion 10*b*, connected together by a neck portion 10*c*. As illustrated in FIG. 13, such sleeve can be formed into a pocket or package by passing the free end of the portion 10*a* into or through the minor portion 10*b*. FIG. 14 shows an arrangement employing such package wherein the free end of the portion 10*a* is passed through a slit 31 and under a member 32, up through an adjacent slit 31, e.g. by levering or prying it upwardly with a blunt blade inserted through the slit, and is then passed through the minor portion 10*b* to form an open ended pocket into which an item such as a coin 18 may be introduced. The free end 42 of the portion 10*a* may then be tucked underneath the portion of the sleeve 10*a* containing the coin 18 or the like, as shown in FIG. 14, in order to close the package.

Figure 15:
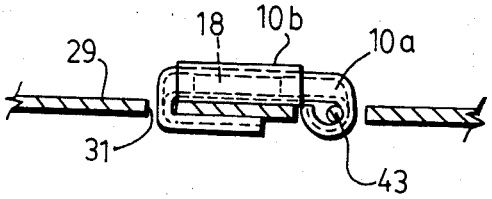

FIG. 15 shows a somewhat similar arrangement wherein after looping the portion 10*a* around a member, e.g. a wire-like member 43 as shown, and inserting the item 18, the free end 42 is passed between a pair of edges e.g. through a slit 31 in order to retain it beneath the supporting surface 29.

Figure 16:
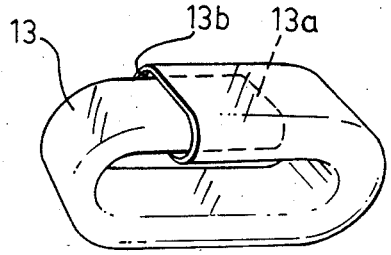
FIG. 16 shows, somewhat schematically, a step in the course of forming a package in accordance with the invention.
Figure 17:
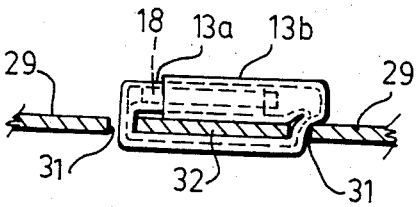
FIGS. 17 to 21 show, somewhat schematically, side views, partly in section, through various forms of supported package in accordance with the invention.

FIG. 16 shows somewhat schematically a package wherein an item such as a coin (not shown) is introduced into one end 13*a* of a sleeve 13, and the end 13*a* is enclosed in an opposite end 13*b* of the tube 13 after, if necessary, reducing the width of the end 13*a* by, for example, pleating it longitudinally. FIG. 17 shows an arrangement employing such package wherein an end 13*a* is retained on the surface 29, the opposite end 13*b* is passed through one slit 31, under the member 32 e.g. by manipulating it or with the use of a thin blade-like instrument or the like, is withdrawn through a further slit 31 and is placed over the end 13*a*, after a coin 18 has been introduced.

Figure 18:
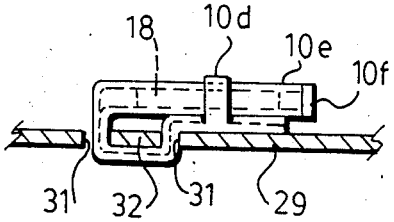

FIG. 18 shows a further variation wherein one end of a tubular sleeve, e.g. a sleeve 10, is formed with an upstanding band 10*d*, for example by making partial transverse slits through it. The oposite end 10*e*, after being introduced through a slit 31, under a member 32, being extracted upwardly through an adjacent slit 31 to the upper side of the support surface 29, has an item such as a coin 18 inserted therein, and then the end 10*e* is closed, e.g. with a seal or adhesive 10*f* or the like, or the end 10*e* is tucked under itself to underlie the portion containing the item 18.

In a further modification, one end of the sleeve 10 may be formed with a single transverse slit, similar to the slit 41 shown in FIG. 11, and an end of the minor portion, e.g. the portion 10*b* formed thereby is sealed, so that when the opposite end of the sleeve is introduced, it is received within a closed-ended pocket.

Figure 19:
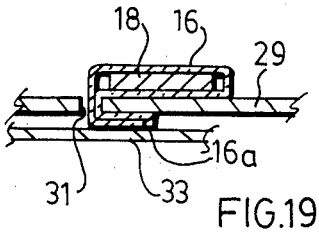
Figure 20:
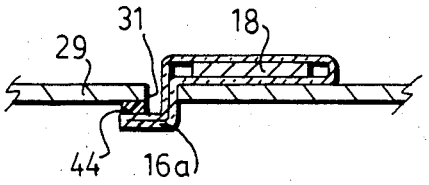

FIGS. 19, 20 and 21 illustrate some examples of methods of employing closed ended bags, such as the bag 16 shown in FIG. 3.

In FIG. 19, the bag, after having the item 18 placed within it, has its free end passed through a slit 31, so that the folded end 16*a* is held between the surface 29 and backing surface 33.

FIG. 20 shows a somewhat similar arrangement except the free end 16 is adhered e.g. with a peelable adhesive tape or a peelable adhesive layer 44 to the underside of the support surface 29.

FIG. 21 shows an arrangement wherein the free end 16*a* is passed through one slit 31, underneath a member 32, withdrawn through a further slit 31, and, depending on the direction in which the end 16*a* is folded or creased, is exposed on the upper side of the member 32 or on the upper side of the adjacent supporting surface 29.

As will be appreciated, in use, the user will be provided with a support surface, e.g. with the bound leaves 23 and 24 provided with the members 32 and slits or other opposed edges, and with sets of sleeves, e.g. the sleeves or bags 10, 13 and 16, or with sheet material, e.g. MYLAR film from which the user can readily fashion folded sleeves, such as the sleeves 10, in order to contain items to be displayed, and which can be removably attached on the support surface employing arrangements such as those described above. As will be seen from the foregoing description, the present invention provides supported display packages of relatively simple construction, which can be manufactured simply and at relatively low cost, and which are highly convenient for the user, since the folded sleeves, bags and the like can be readily re-arranged, removed and replaced on the support surface, and can be formed to accommodate snugly items of varying diameters or sizes.

I claim:

1. A supported package for displaying small items, comprising a generally tubular sleeve comprising transparent material through which small items placed inside the sleeve can be viewed, and a generally planar support member on which the sleeve in flattened form is disposed, the support member comprising an upper sheet having a pair of spaced parallel slots therein, a lower sheet parallel to the upper sheet, and an auxilaiary portion extending rearwardly from the upper sheet between said slots toward said lower sheet and defining a recess on each side of the auxilaiary portion between the upper and lower sheets, each end of said flattened sleeve being folded over on itself and inserted through a respective said slot and disposed in a respective recess and the upper and lower sheets compress each folded over end of the sleeve between them in each respective said, whereby movement of the end of the sleeve transversely of the slot in the direction parallel to the plane of the upper sheet and unfolding of the folded over end and withdrawal thereof from the slot is resisted.

2. A package according to claim 1 wherein the width of each slot is relatively small compared to the folded over length of each end of the sleeve.

3. A package according to claim 2 wherein each slot is a slit of which the opposing edges are substantially continuous.

4. A package according to claim 1 wherein the auxiliary portion comprises strip material connected at one end to the upper sheet and having its opposite end extend adjacent and parallel to the upper side of the lower sheet a distance at least approximately the same as the length of the folded over end portion.

5. A package according to claim 1 wherein said upper sheet is a card and said slots comprises slits in the card, and the lower sheet is card.

6. A package according to claim 1 wherein said tubular sleeve comprises a folded sheet of film material.

7. A package according to claim 1 wherein said sleeve comprises material having a dead fold characteristic.

8. A package according to claim 7 wherein said material is polyester film.

* * * * *